US006755594B1

(12) United States Patent
Jacoway et al.

(10) Patent No.: US 6,755,594 B1
(45) Date of Patent: Jun. 29, 2004

(54) DIVING HARNESS SYSTEM

(75) Inventors: William W. Jacoway, San Diego, CA (US); Robert B. Jacoway, Poway, CA (US)

(73) Assignee: DeepOutdoors, Inc., Poway, CA (US)

( * ) Notice: Subject to any disclaimer, the term of this patent is extended or adjusted under 35 U.S.C. 154(b) by 0 days.

(21) Appl. No.: 10/377,441

(22) Filed: Feb. 28, 2003

(51) Int. Cl.[7] ..... B63C 9/08; B63C 11/02
(52) U.S. Cl. ..... 405/186; 441/106
(58) Field of Search ..... 405/185, 186; 441/80, 106, 108; 114/315, 331

(56) References Cited

U.S. PATENT DOCUMENTS 4,732,305 A 3/1988 Courtney et al.
5,205,672 A 4/1993 Stinton
5,641,247 A 6/1997 Seligman
5,724,707 A 3/1998 Kirk
5,902,073 A 5/1999 Eungard et al.
6,030,147 A 2/2000 Bowden
6,132,142 A 10/2000 Carmichael
6,146,053 A * 11/2000 Nelson ..... 405/186

FOREIGN PATENT DOCUMENTS

GB 1587124 A * 4/1981 ..... A45F/3/14

* cited by examiner

*Primary Examiner*—Heather Shackelford
*Assistant Examiner*—Lisa M. Saldano
(74) *Attorney, Agent, or Firm*—Gordon & Rees LLP

(57) ABSTRACT

The invention relates to a diving harness system with webbing straps that securely fasten diving weight pockets, equipment, and other accessories in an interwoven, alternating and interlocking fashion. The invention may include two pair of webbing straps and three pair of webbing loops that comprise the interwoven attachment site. The webbing straps also secure the diving harness system to the diver by semi-permanently engaging fastening devices to form belt-like devices. The invention may further include the webbing straps engaging D-rings, other straps, equipment, keepers, ladder locks, and other fastening devices.

29 Claims, 5 Drawing Sheets

FIG. 4A
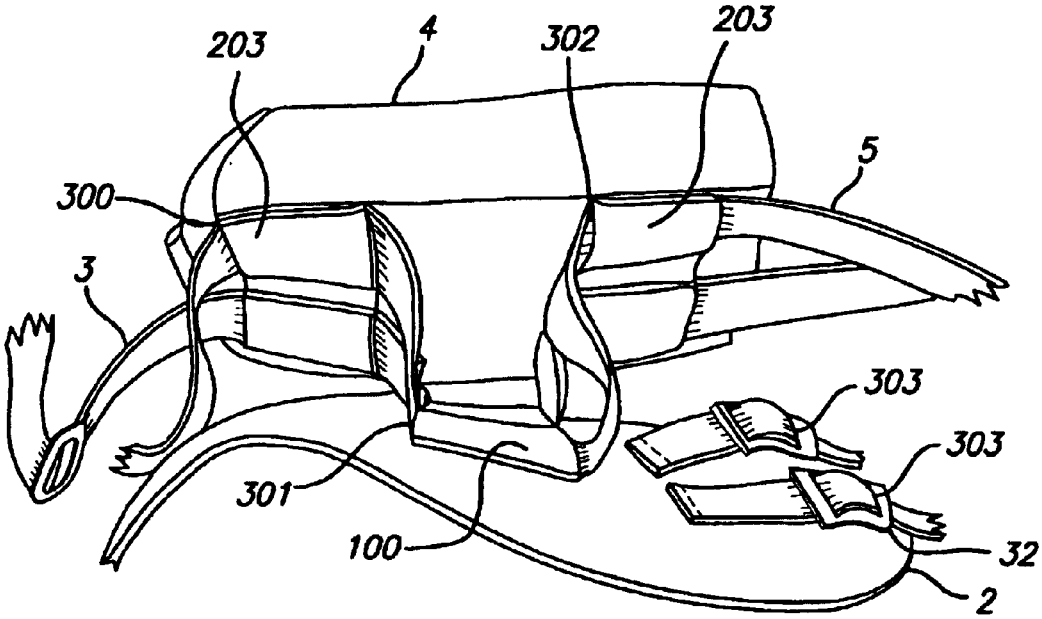
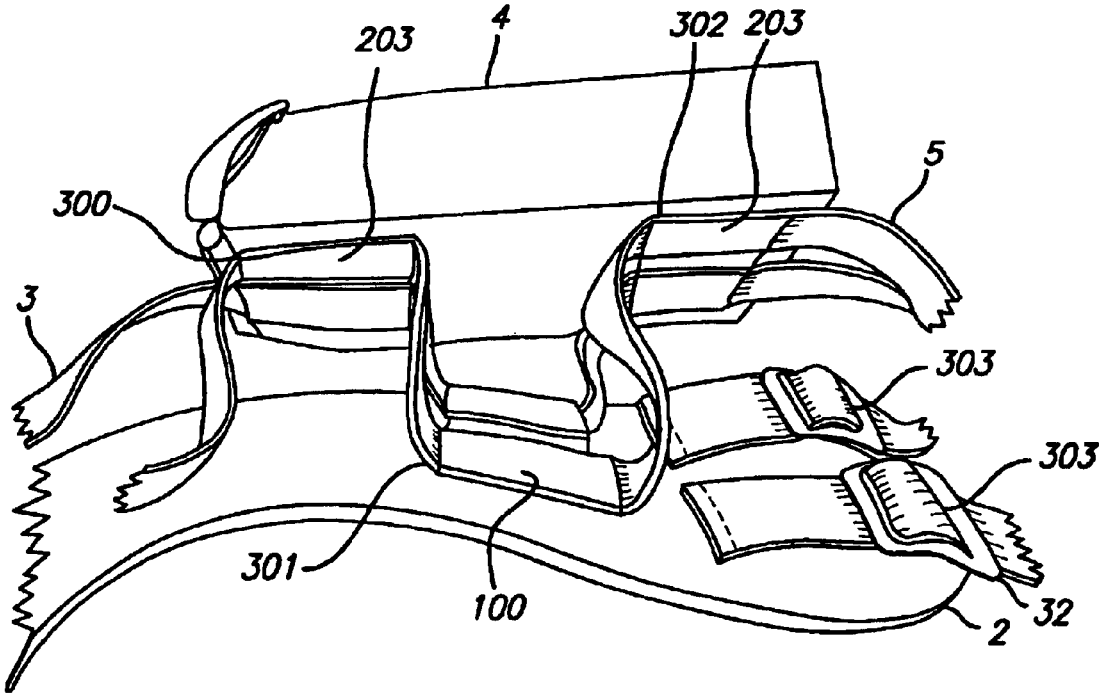
FIG. 4B

DIVING HARNESS SYSTEM

BACKGROUND

This invention relates to an improved diving harness system, to be worn by underwater divers.

The self contained underwater breathing apparatus ("SCUBA") or other compressed air tank is attached to the back of a diver. Often times, the tanks are attached to a backplate that can, in turn, be attached to a diving jacket harness system. Typically, such harness systems have integral shoulder and waist straps. Harness systems may also have various equipment, weight pockets and other accessories located on the front or side panels of the harness. Weight pockets allow the diver to wear weights attached to the harness in lieu of a separate weight belt and provide a means to adjust the diver's buoyancy.

Prior attempts at fastening items, especially heavy items like diving weights, have generally placed the weights on a belt directly, placed weights in fixed pockets on a belt, or within the diving jacket. The diving weights must be securely and releasedly fastened to the diver's equipment, yet this often results in a trade off of diminished comfort. Many prior attempts have therefore tried to fasten items, especially diving weights, in a secure manner while endeavoring to increase the level of comfort.

Recent prior efforts have attached accessories and weights in a variety of attempts. For example, U.S. Pat. No. 5,902,073 granted to Eungard, et al. explains that weights are inserted into fixed pockets on a belt. The weights themselves are removable, but the pockets are not removable, adjustable, nor are the weights designed to conform to the human figure, although this invention incorporates many other features that conform to a human, especially a female, torso. The invention of U.S. Pat. No. 5,641,247 granted to Seligman uses diving weights in envelopes with stiffening material to prevent sagging, but the pockets are fixed and therefore not adjustable. Although U.S. Pat. No. 5,724,707 granted to Kirk, et al. provides a method to attach pockets in different positions on a jacket in a dry land embodiment, the fastening of the pocket is most likely not able to retain diving weights sufficiently or safely, chiefly due to a snap fastener. The invention of U.S. Pat. No. 6,030,147 granted to Bowden also uses envelopes with stiffening material to retain malleable diving weights that can be shaped to better conform to an individual diver. However, the Bowden invention still has fixed pocket locations on a diving jacket that cannot be adjusted.

Both U.S. Pat. No. 6,146,053 granted to Nelson and U.S. Pat. No. 5,205,673 granted to Stinton teach inventions that attach adjustable diving weight pockets to a diving belt with belt loops and/or slits on the back of sleeves/panels which have a plurality of pockets. The sleeves or panels may slide along the length of the belt in order to shift the position of the weights. The sleeve of the Nelson invention, despite the required "spacers" designed to retain the position of the sleeve, will most likely not comfortably conform to the shape of a diver due to the size of the sleeves and would probably need to be continually readjusted to stay in the same place during a dive, especially at depths with noticeable pressure changes. Further, tightening or loosening the suspenders adjusts the Stinton invention, which provides only limited verticle weight pocket placement choices for a diver and is subject to the same horizontal adjustment challenges of the Nelson invention. In a like manner, U.S. Pat. No. 4,732,305 granted to Courtney, et al. teaches a diver weight belt in which diving weights are placed within elongated panels on a single belt. The elongated panels may be moved about the belt and are designed to conform to the shape of the diver's hips, however, the loops attached to the back of the panels are most likely prone to unwanted vertical movement up and down the belt as well as horizontal movement along the belt, thus also not providing an integral fit of panels and belt to a diver. Further, U.S. Pat. No. 6,132,142 granted to Carmichael teaches a partially elasticized dive belt to better compensate for pressure changes. The Carmichael invention also has D-rings and pockets that receive quick release diving weights, but again, the pockets are permanently fixed in one position on the belt. Unlike harness systems, diving weight belts, when used with current diving equipment, may be uncomfortable, awkward and inconvenient for a diver. Additionally, diving weight belts must be worn snugly around the waist of the diver to ensure that the belt does not slip from the intended position of the diver or even fall off of the diver.

The drawbacks of present configurations as well as other prior attempts include fixed pockets or other accessories that are not interchangeable and/or interchangeable pockets or other accessories that do not have a close and secure attachment to the harness. A close and secure fit is particularly important when attaching modular weight pockets to a harness system.

There is obviously a need for a diving harness system with a pocket and accessory attachment system that is truly secure and firmly attaches to a diving jacket while remaining flexible. The diving harness system should allow accessories, equipment and various pockets to be easily interchanged, as well as serve as a belt-type apparatus to secure the diving jacket harness system to the diver. The system should also provide for quick release of diving weights for safety reasons. Such a system would provide a diver the freedom to configure and re-configure a diving harness system to meet the particular diving needs for each dive while ensuring greater comfort, functionality, and increased utility. The attachment system should be flexible while giving sufficient support and ensuring safety mechanisms. Finally, the needed diving harness system should function as one integral harness system by constructively merging the diving jacket, pockets (especially weight pockets), specific accessories and webbing straps into a single piece of equipment once a desired configuration is determined and configured for that specific dive.

SUMMARY

It is an object of the present invention to overcome the shortcomings of the prior attempts addressed above.

Another object of the present invention is to provide a diving harness system with an improved method of attaching accessories such as pockets or modular weight attachments.

It is a further object of the present invention to provide a diving harness system with an interwoven webbing pocket and accessory attachment system that is truly secure and firmly attaches with a diving jacket.

Another object of the present invention is to have an interwoven webbing pocket and accessory attachment system that is flexible.

A further object of the present invention is to have an interwoven webbing pocket and accessory attachment system that is easy to use and interchange accessories and pockets.

Yet another object of the present invention is that the webbing straps used for attachment of pockets and various accessories to also serve as belt-type apparatus to releasably secure the diving jacket harness system to the diver.

Another object of the present invention is to provide the diver freedom to construct the harness system to meet their particular diving needs.

Still a further object of the present invention is to ensure greater diver comfort while using the diving harness system with the pockets and accessories attached such that the entire diving harness system merges together to behave as a single piece of equipment.

The present invention of a diving harness system comprises a diving jacket, which is basically worn like a vest, webbing straps, pockets, and diving accessories, all designed for underwater diving. One unique feature of the present invention is the method used for attaching pockets and/or accessories. This attachment method of the present invention includes at least two parallel and independent pair of webbing strap members that at least partially encircle the ventral portion of the torso of the diver. The webbing straps are permanently attached to or near to the back of the diving jacket. The webbing strap members are designed to releasably engage pockets or other accessories in a variety of methods, one being by weaving through two parallel and linear series of evenly spaced loops (akin to wide belt loops) in an alternating fashion. For example, the webbing strap members may first be threaded through at least one D-ring apparatus, then through a pair of loops attached to the back of the pocket or accessory, next through a pair of loops attached to the diving jacket, then through another pair of loops attached to the back of the pocket or accessory, then through a ladder lock attached to the diving jacket, possibly through more accessories or attachment devices, and finally through a fastening device for securing the diving harness system to the diver. Each webbing strap member, therefore, passes through a total of at least three loops per pocket or accessory as well as through many other items before being secured to the corresponding webbing strap member to form a belt-like device. The alternating loops of the pocket or accessory as well as the diving jacket fit in an almost dovetail fashion so that when the webbing straps are tightened, a very secure, flexible, and generally flat attachment site is formed. The present invention allows the diver to easily change the configuration and orientation of the pockets, accessories, D-rings, and other attachment devices about the webbing straps. Although D-rings and other attachment devices may be attached elsewhere on the diving harness system, the interwoven attachments and webbing straps are limited in location because the webbing straps serve as belt-like structures to secure the harness system to the diver. The present invention of a diving harness system is designed and intended for underwater diving.

The use of the term "webbing loop" herein is not intended to be limiting; a webbing loop is constructed of the same material used in a webbing strap, but sewn so that a ring, or loop, of webbing is formed so that a second webbing may be threaded through the webbing loop. Likewise, the term "webbing strap member" or "member" is a portion of a webbing strap. Although the webbing straps, members, and webbing loops may comprise nylon webbing, other materials are suitable for use as connecting means, including but not limited to cloth, rubber, plastic, and any other suitably resilient material. Additionally, other shapes including, but not limited to, ropes, strands, and tubes, are contemplated for use besides straps.

The use of the term "pocket" herein is not intended to be limiting. The invention relates to attaching a variety of different accessories to a diving harness including, but not limited to, equipment pockets, weight integration pockets, diving light holders, load deployment systems, accessory bags, Jon lines, writing instruments, pony bottles, straps, and devices to further secure the diving harness system to the diver.

These and other features, aspects, and advantages of the present invention will become better understood with reference to the following description, appended claims and drawings.

BRIEF DESCRIPTION OF THE DRAWINGS

FIGS. 4*a* and 4*b* show the member portion of the webbing straps used to affix the pocket to the harness by threaded though the webbing loops.

DESCRIPTION

The invention is a diving harness system for use in underwater diving. The invention is designed to provide a diver the ability to change the orientation and, arrangement of pockets on a webbing belts of a diving jacket while providing a very secure, generally flat and yet flexible attachment site of interwoven webbing.

Figure 1:
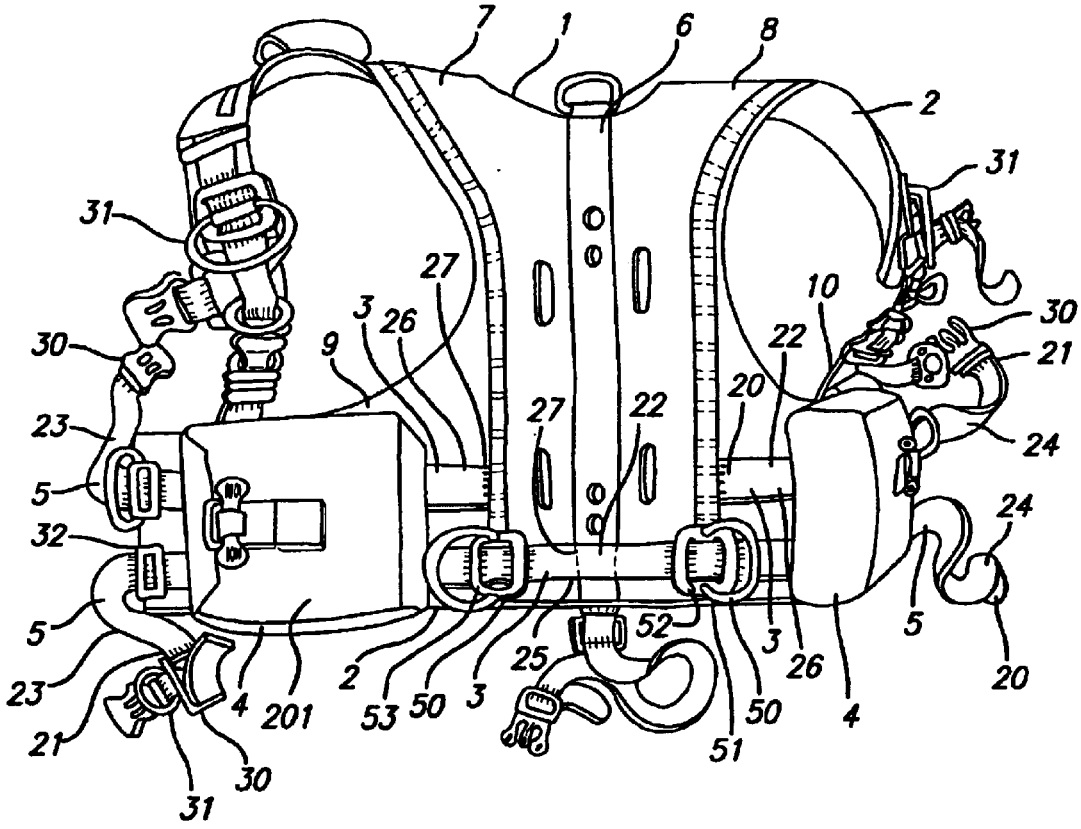
FIG. 1 shows an overall view of the back of the diving harness system, including the diving jacket, webbing straps, pockets, fastening devices and member portions used to affix the pockets to the diving jacket.

As shown by FIG. 1, an overall view of the back of the diving harness system 1, including the diving jacket 2, webbing straps 3, pockets 4, and member portions 5 used to affix the pockets 4 to the diving jacket 2. The diving jacket is worn similar to a vest and, like a vest, has a back portion 6, right shoulder portion 7, left shoulder portion 8, right front portion 9, and left front portion 10.

The diving jacket has a plurality of webbing straps 3 attached to the diving jacket 2. Each webbing strap has a first end 20, a second end 21, and a middle 22 and is attached to the diving jacket so that at least one of the ends of each the webbing strap extends beyond one of the front portions to form a webbing member 5. The members comprise at least one right member 23 and at least one left member 24. Each right member 23 proceeds from the right front portion 9 and each left member 24 proceeds from the left front portion 10 to form a corresponding right and left pair of members. In this embodiment, the one of the webbing straps is continuous around the entire jacket to form two members 25 and the other two members consist of two different and corresponding webbing straps to form the second two members 26. Further, the webbing straps are permanently attached 27 to or near the back of the jacket with one pair of parallel members 23 on the right side and a second pair of parallel members 24 on the left side.

At least one, preferably two, fastening device 30 is designed to releasedly engage and attach at least one right 23 and left member 24 pair, forming a belt-like device 400 to secure the harness system to a diver. More specifically, the corresponding members may fasten the jacket to the diver generally at the ventral midsection of the torso of the diver.

Also, the pockets 4, D-rings 31, keepers 32, and all external parts of the diving jacket can be seen. The pockets are attached to the jacket by threading the members though by jacket webbing loops 100 and pocket webbing loops 203.

The webbing straps 3 are also designed to retain at least one, preferably two, D-ring apparatuses 50. The D-ring apparatus comprises a D-ring 51 attached to a plate 52 that has at least two parallel slots 53 that are oriented perpendicular to the webbing straps 3. The webbing straps 3 are threaded through the slots and so remain independent from 5 the diving jacket 2 while permitting attachment sites for the various needs of the diver. Specifically, the diver may attach, either to the webbing straps 2 directly or to the D-rings 31 or 51, such items as load deployment systems, accessory bags, Jon lines, writing instruments, pony bottles or other straps and devices to further secure the harness to the diver.

Figure 2:
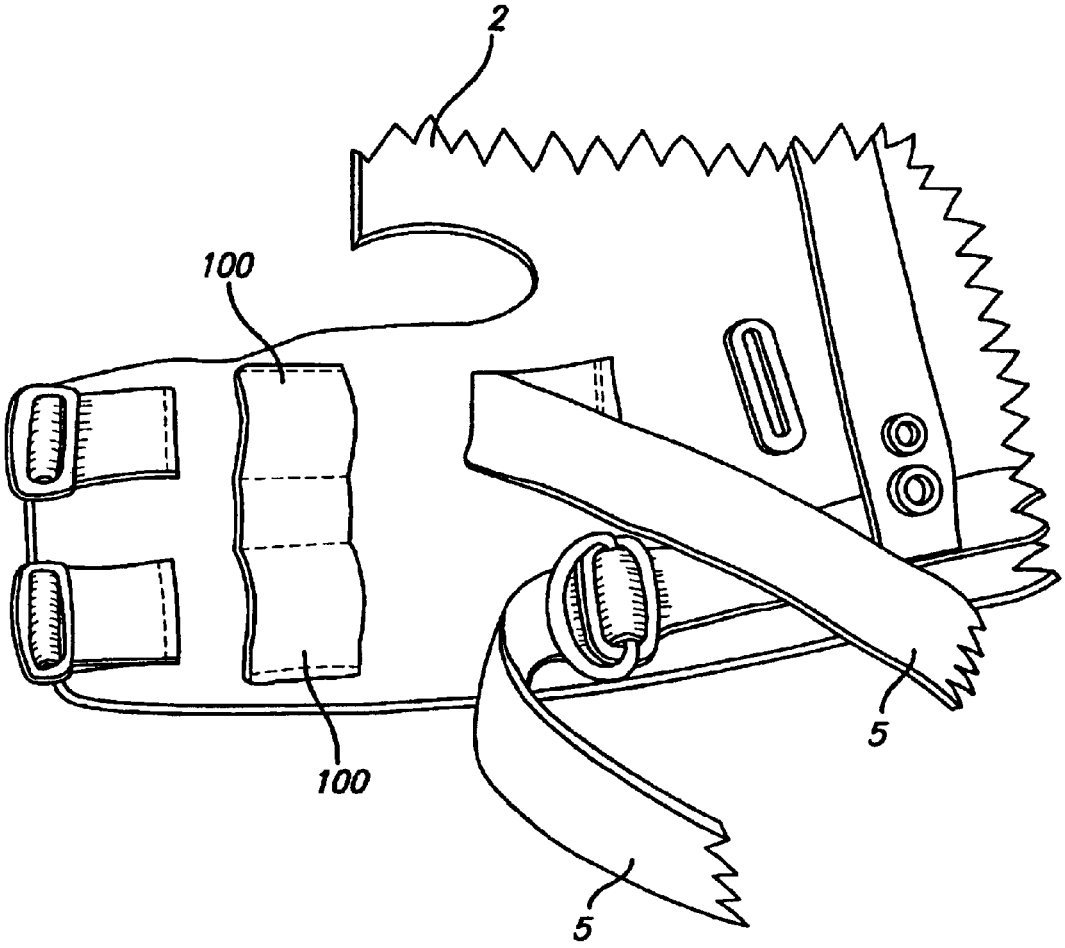
FIG. 2 shows the diving jacket, a pair of jacket webbing loops, and ladder lock, preferably a slideably attached ladder lock.

Referring now to FIG. 2, the members 5 are used first to fasten pockets 4 to the jacket 2 and then to fasten the right front portion 9 and left front portion 10 together to secure the jacket to the diver. To hold the members 5 near the front of the jacket is at least one jacket webbing loop 100 per member, preferably at least one pair of jacket webbing loops with one jacket webbing loop on the right front portion and the other jacket webbing loop on the left front potion of the jacket. The jacket webbing loops are permanently attached to the jacket and designed to be oriented perpendicular to the webbing straps so that the each member may be threaded through the corresponding jacket webbing loop.

Figure 3:
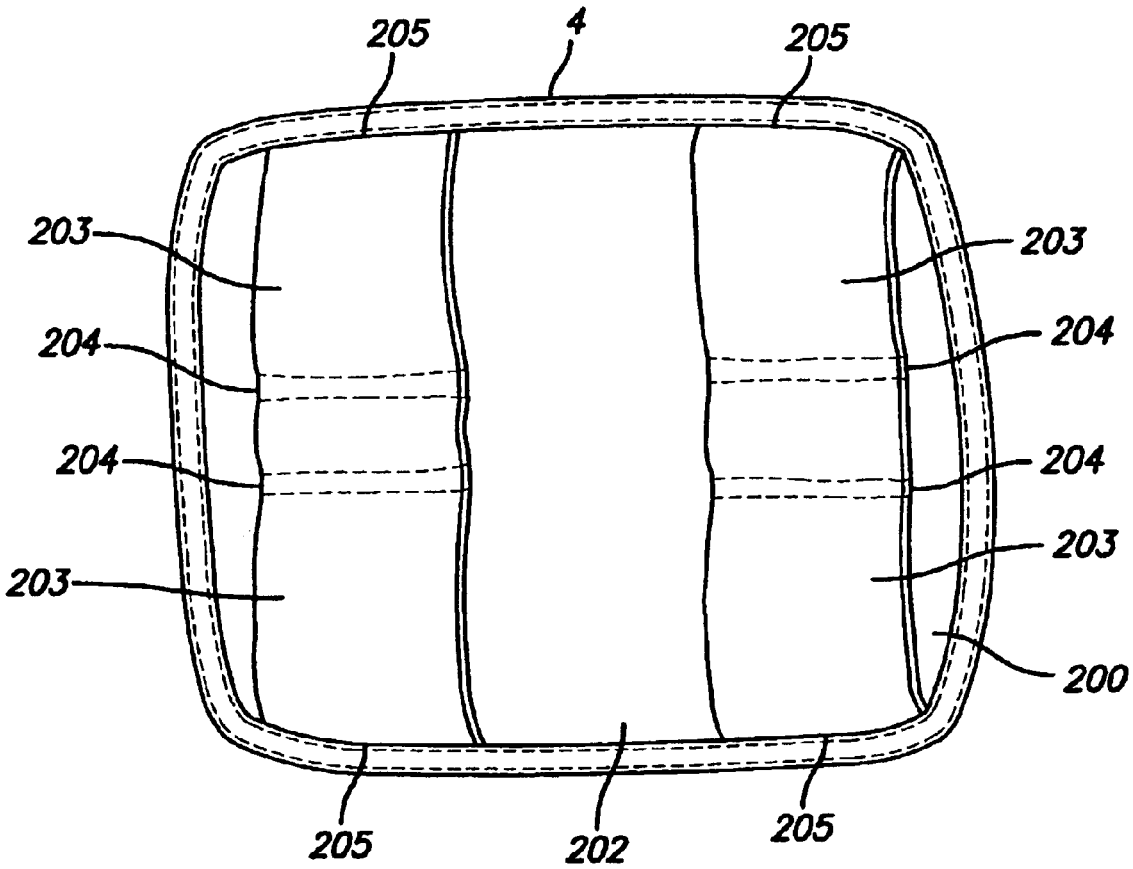
FIG. 3 shows the back of a pocket with two pair of pocket webbing loops.

Referring now to FIG. 3, the back of a pocket 4, designed to be attached to the jacket 2 by the members 5 to complete the diving harness system 1, is shown. Each of the pockets 4, preferably with poly sheeting 200 to serve as stiffening material, have a front side 201 which faces out from the diver as well as a back side 202, which faces the diver, and thus the jacket. The backside of the pockets each have at least two, preferably two pair, of pocket webbing loops 203, which are also designed to be oriented perpendicular to the webbing straps 3 so that each member 5 may be threaded through the corresponding pocket webbing loops 203 in order to attach the pocket 4 to the jacket 2. In a preferred embodiment, a right pocket is attached to the right front portion and a left pocket is attached to the left front portion of the jacket by the corresponding members and the webbing loops. In a preferred embodiment, the webbing loops comprise a first pair and a second pair of pocket webbing loops 203 and one pair of the diving jacket webbing loops 100 on the right front portion and one pair of the diving jacket webbing loops on the left front portion, or a ratio of jacket webbing loops to pocket webbing loops of n to n+1.

In this embodiment, there are two pocket webbing loops 203 and one jacket webbing loop 100 per member 5. Specifically, each pocket webbing loop is attached to the back side 202 of the pocket near the center 204 of the webbing loop as well at each end 205 of the webbing loop to form a total of two pair of webbing loops. The two parallel pairs of pocket webbing loops 203 on each pocket 4, preferably one right and one left pocket, are spaced apart to allow a jacket webbing loop 100 pair to sit between the pair of pocket webbing loops in a near dovetail fashion to form a generally planar set of three pair of parallel webbing loops. Additionally, the webbing loops are designed to align so that the three pairs of side-by-side loops form two parallel channels so that one of the members 5 may be threaded through one of these webbing loop channels.

One of the reasons to have the pockets not permanently attached to the jacket is so that different pockets or different numbers of pockets, or different accessories and equipment, may be attached to the jacket as is suited for the particular needs of the diver. The embodiment shown has two pockets, one on the right and one on the left, with each pocket securely and releasedly retaining a diving weight or a diving weight apparatus.

Referring now to FIGS. 4*a* and 4*b*, the plurality of webbing straps 3, preferably two pair nylon webbings, designed to attach the pockets 4 to the jacket 2 are shown. In a preferred embodiment, the webbing straps comprise four members 5 that consist of two pair, specifically, two right members 23 and two left members 24. The members then may first fasten the pockets, or possibly other attachments, to the jacket and then releasably engage at least one fastening device 30 between corresponding right members and a left members to secure the jacket to the diver.

The operation of threading the members through the webbing loops is simple. The pocket webbing loops 203 and the jacket webbing loops 100 are designed to be sequentially engaged by the members in an alternating, generally linear fashion. Specifically, the members are designed to be threaded through a pocket webbing loop 300, then though a webbing loop on the diving jacket 301, then through a second pocket webbing loop 302, then through a keeper 303, preferably a ladder lock, and finally through a fastening device.

When the members are pulled tight, the pockets and the jacket will tightly sandwich a generally planar interlocking composition of webbing members and webbing loops because the jacket webbing loop 100 will nest, or intermesh, between the two parallel pocket webbing loops 203. This planar intermeshing and interlocking of the webbing holds the pocket 4 tightly against the jacket 2, prevents the pocket from shifting back and forth, and allows the member 5 to reside within the webbing loop channel unhindered from forming an uninterrupted curvilinear belt-like device 400 for a secure and comfortable fit of the diving harness system. In a preferred embodiment, two pair of right and left members are interwoven through the corresponding right and left webbing loops in a symmetrical manner to form two parallel belt-type devices 400.

Once a member has been threaded through the jacket webbing loops 100 and the pocket webbing loops 203, the member is then threaded through either a right keeper 32 or a left keeper 32, preferably a slideably attached right or left ladder lock, that is attached to the jacket 2. The keepers attached to the diving jacket are designed to semi-permanently retain the members, more specifically, the right keepers semi-permanently retaining the right members and the left keepers semi-permanently retaining the left members. Further, the keepers, preferably ladder locks, are designed to engage the middle 22 of the member portion 5 of the webbing straps 3 and enable the member portion of the webbing strap to remain unattached from the jacket 2 and pockets 4. The members may then engage other accessories, equipment, straps, other items or fastening devices following the pocket attachment and ladder locks.

Figure 5:
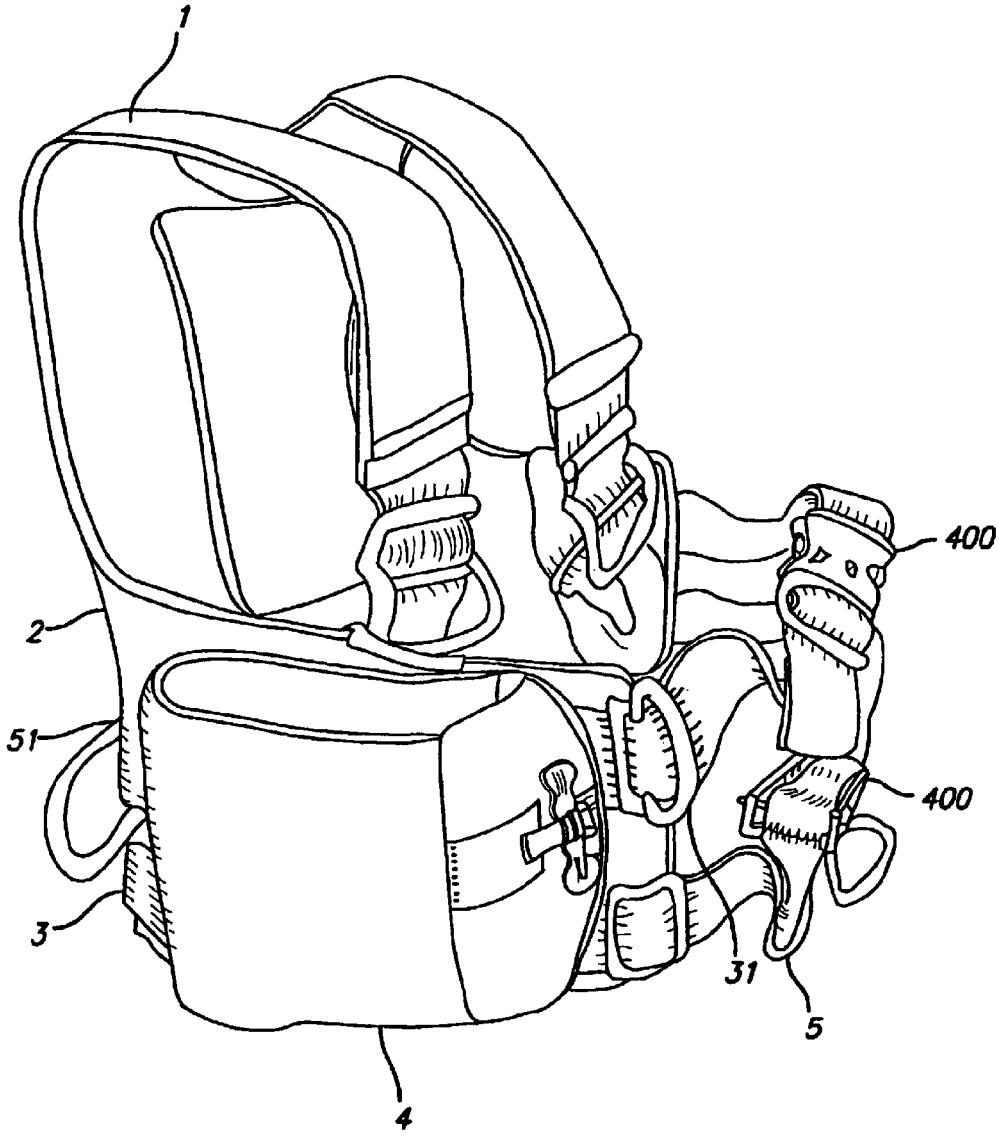
FIG. 5 shows a weight integration pocket attached to a diving harness and D-rings.

Referring now to FIG. 5, a pocket 4 containing a weight apparatus is shown attached to a diving jacket 2 by a member 5 and corresponding webbing loops to form the harness system 1 of the present invention.

The pocket 4 and other items engaged by the members or webbing strap 3 or D-ring 31 or 51 may not be located anywhere on the jacket beyond the location of the members 5 or attached D-rings, which are preferably located about the torso of the diver. The fastening devices 30, attached to members 5, are shown in FIG. 5 engaged to form the belt-like devices 400.

The above descriptions describe many advantages of various embodiments, including preferred embodiments. It is important to note, however, that the invention does not require that all these advantages need be incorporated into every embodiment of the invention.

Although the present invention has been described in considerable detail with reference to certain preferred versions thereof, other versions are possible. For example, the number of webbing loops can vary on both the harness and the pocket. The number and size of webbing loops can be varied to accommodate the number and size of members threaded through the webbing loops. Also, any number of webbing straps and/or webbing loops can be used as long as the number and location of webbing loops provide for the members to be interwoven to form the intermeshing and interlocking attachment sites as well as proceed from the attachments and ladder locks to form belt-like devices.

All of the features disclosed in this specification and drawings may be replaced by alternative features serving the same, equivalent or similar purpose, unless expressly stated otherwise. Therefore, the spirit and scope of this specification should not be limited to the description of the preferred versions contained herein.

We claim:

1. A diving harness system having an interwoven pocket orientation, comprising:

a. a diving jacket with a back portion, a right shoulder portion connected to said back portion, a left shoulder portion connected to said back portion, a right front portion connected to said right shoulder portion and said back portion, a left front portion connected to said left shoulder portion and said back portion;

b. a plurality of webbing straps attached to said diving jacket, each said webbing strap with a first end, a middle, and a second end, said webbing straps attached to said diving jacket designed so that at least one of said ends of each said webbing strap extends beyond one of said front portions to form a webbing member, said webbing straps further designed so that said members form at least one right member and at least one left member so that each said right member proceeds from said right front portion and each said left member proceeds from said left front portion to form a corresponding right and left pair of members;

c. at least one fastening device designed to releasably engage one said pair of right and left members to form a belt-like device to secure said diving harness system to a diver;

d. at least one pocket, said pocket with a front side and a back side, said back side designed to face said diving jacket, said pocket having at least one pocket webbing loop attached to said back side of said pocket, said pocket webbing loop designed to be oriented perpendicular to said webbing straps and further designed to be insertably engaged by said webbing straps, said pocket designed to be independent from said diving jacket;

e. at least one jacket webbing loop attached to said diving jacket, said jacket webbing loop designed to be oriented perpendicular to said webbing straps and further designed to be insertably engaged by one of said members;

f. at least one right keeper and one left keeper, said keepers attached to said diving jacket and designed such that said right keeper semi-permanently retains said right member and said left keeper semi-permanently retains said left member, said keepers further designed to engage said middle of said webbing straps to enable said webbing strap ends to remain unattached to said jacket and said pocket;

g. a sequential engagement of said pocket webbing loops and said jacket webbing loops by said members in an alternating, generally linear fashion whereby said webbing,straps are alternatively passed through at least one webbing loop on said pocket and then through at least one webbing loop on said diving jacket;

h. at least one webbing strap D-ring apparatus, said webbing strap D-ring apparatus having a D-ring attached to a plate, said plate having at least two parallel slots, said slots designed to be oriented perpendicular to said webbing straps and further designed to be insertably engaged by said webbing straps, said webbing strap D-ring apparatus designed to be independent from said diving jacket and threadably attached to said jacket by said webbing straps.

2. The diving harness system of claim 1, said webbing straps comprising nylon webbing.

3. The diving harness system of claim 2, said right and left members further comprising two pair of right and left members.

4. The diving harness system of claim 3, wherein for each individual right or left member of said members, said pocket webbing loops comprise two webbing loops per pocket.

5. The diving harness system of claim 4, wherein each jacket webbing loop corresponds with one member at the corresponding said front portion.

6. The diving harness system of claim 5, comprising a first pair and a second pair of said pocket webbing loops on each said pocket and one pair of said diving jacket webbing loops on said right front portion and one pair of said diving jacket webbing loops on said left front portion.

7. The diving harness system of claim 6 wherein each of said members is designed to be generally linearly threaded through said first pair of pocket webbing loops, then threaded through said pair of diving jacket webbing loops, then threaded through said second pair of pocket webbing loops, then through said keeper, and finally through a fastening device to form a belt-like device.

8. The diving harness system of claim 7, wherein said design of threading said webbing straps through said webbing loops comprises a generally planar and interlocking composition of webbing.

9. The diving harness system of claim 8 further comprising at least one pocket fastened to said left front portion and at least one pocket fastened to said right front portion.

10. The diving harness system of claim 9 wherein said pockets are designed to securely and releasedly retain diving weights.

11. The diving harness system of claim 1 further comprising an accessory attached to said webbing straps, said accessory selected from the group consisting of D-rings, equipment pockets, weight integration pockets, diving light holders, load deployment systems, accessory bags, Jon lines, writing instruments, pony bottles, straps, and devices to further secure said diving harness system to the diver.

12. The diving harness system of claim 11 comprising a plurality of accessories attached to the webbing straps.

13. A diving harness system having an interwoven pocket orientation, comprising:

a. a diving jacket with a back portion, a right shoulder portion connected to said back portion, a left shoulder portion connected to said back portion, a right front portion connected to said right shoulder portion and said back portion, a left front portion connected to said left shoulder portion and said back portion;

b. a plurality of webbing straps attached to said diving jacket, each said webbing strap with a first end, a middle, and a second end, said webbing straps attached to said diving jacket designed so that at least one of said ends of each said webbing strap extends beyond one of said front portions to form a webbing member, said webbing straps further designed so that said members form at least one right member and at least one left member so that each said right member proceeds from said right front portion and each said left member proceeds from said left front portion to form a corresponding right and left pair of members;

c. at least one fastening device designed to releasably engage one said pair of right and left members to form a belt-like device to secure said diving harness system to a diver;

d. at least one pocket, said pocket with a front side and a back side, said back side designed to face the diver and thus said diving jacket, said pocket having at least one pocket webbing loop attached to said back side of said pocket, said pocket webbing loop designed to be oriented perpendicular to said webbing straps and further designed to be insertably engaged by said webbing straps, said pocket designed to be independent from said diving jacket;

e. at least one jacket webbing loop attached to said diving jacket, said jacket webbing loop designed to be oriented perpendicular to said webbing straps and further designed to be insertably engaged by one of said members;

f. at least one right keeper and one left keeper, said keepers attached to said diving jacket and designed such that said right keeper semi-permanently retains said right member and said left keeper semi-permanently retains said left member, said keepers further designed to engage said middle of said webbing straps to enable said webbing strap ends to remain unattached to said jacket and said pocket;

g. a sequential, engagement of said pocket webbing loops and said jacket webbing loops by said webbing straps in an alternating, generally linear fashion whereby said members are alternatively passed through at least two webbing loops on said pocket and at least one webbing loop on said diving jacket, and thus the ratio of jacket webbing loops to pocket webbing loops is n to n+1;

h. at least one webbing strap D-ring apparatus, said webbing strap D-ring apparatus having a D-ring attached to a plate, said plate having at least two parallel slots, said slots designed to be oriented perpendicular to said webbing straps and further designed to be insertably engaged by said webbing straps, said webbing strap D-ring apparatus designed to be independent from said diving jacket and threadably attached to said jacket by said webbing straps.

14. The diving harness system of claim 13 wherein said webbing straps are designed to embrace and fasten generally at the ventral midsection of the torso of a diver using said diving harness system.

15. The diving harness system of claim 14, said right and left members comprising two pair of corresponding right and left members.

16. The diving harness system of claim 15, wherein each jacket webbing loop corresponds with one member at the corresponding said front portion.

17. The diving harness system of claim 16, further comprising a first pair and a second pair of said pocket webbing loops on each said pocket and one pair of said diving jacket webbing loops on said right front portion and one pair of said diving jacket webbing loops on said left front portion.

18. The diving harness system of claim 17 wherein each of said members is designed to be generally linearly threaded through said first pair of pocket webbing loops, then threaded through said pair of diving jacket webbing loops, then threaded through said second pair of pocket webbing loops, then through said keeper, and finally through a fastening device to form a belt-like device.

19. The diving harness system of claim 18 wherein said design of threading said webbing straps through said webbing loops comprises a generally planar and interlocking composition of webbing.

20. The diving harness system of claim 19 further comprising at least one pocket fastened to said left front portion and at least one pocket fastened to said right front portion.

21. The diving harness system of claim 20 wherein said keepers comprise ladder locks.

22. The diving harness system of claim 21 wherein said pockets are designed to securely and releasedly retain diving weight apparatuses.

23. The diving harness system of claim 13 further comprising an accessory attached to said webbing straps, said accessory selected from the group consisting of D-rings, equipment pockets, weight integration pockets, diving light holders, load deployment systems, accessory bags, Jon lines, writing instruments, pony bottles, straps, and devices to further secure said diving harness system to the diver.

24. The diving harness system of claim 23 comprising a plurality of accessories attached to the webbing straps.

25. A diving harness system having an interwoven pocket orientation, comprising:

a. a diving jacket with a back portion, a right shoulder portion connected to said back portion, a left shoulder portion connected to said back portion, a right front portion connected to said right shoulder portion and said back portion, a left front portion connected to said left shoulder portion and said back portion;

b. a plurality of webbing straps attached to said diving jacket, each said webbing strap with a first end, a middle, and a second end, said webbing straps attached to said diving jacket designed so that at least one of said ends of each said webbing strap extends beyond one of said front portions to form a webbing member, said webbing straps further designed so that said members form at least one right member and at least one left member so that each said right member proceeds from said right front portion and each said left member proceeds from said left front portion to form a corresponding right and left pair of members;

c. at least one fastening device designed to releasably engage one said pair of right and left members to form a belt-like device to secure said diving harness system to a diver;

d. a first pocket and a second pocket, each of said pockets having poly sheeting as a stiffening material, each of said pockets with a front side and a back side, said back side designed to face said diving jacket, said first pocket and said second pocket each having two pair of pocket webbing loops attached to said back side of said pockets, said pocket webbing loops designed to be oriented perpendicular to said webbing straps and each said pair of pocket webbing loops further designed to be insertably engaged by one of said webbing straps, said first pocket engaged by said left webbing straps and said second pocket engaged by said right webbing straps, said pockets designed to be independent from said diving jacket and further designed to securely retain at least one diving weight apparatus;

e. at least two jacket webbing loops attached to said front portion so that each jacket webbing loop corresponds with one member at the corresponding said front portion, said jacket webbing loops designed to be oriented perpendicular to said webbing straps and further designed to be insertably engaged by said members;

f. a pair of slideably attached right ladder locks and a pair of slideably attached left ladder locks, said ladder locks slideably attached to said diving jacket and designed such that said right ladder locks semi-permanently retain said right members and said left ladder locks semi-permanently retain said left members and said ladder locks further designed to engage said middle of said webbing straps to enable said webbing strap ends to remain unattached to said jacket and said pocket;

g. a sequential engagement of said pocket webbing loops and said jacket webbing loops by said webbing straps in an alternating, generally linear fashion whereby said members are alternatively passed through at least one webbing loop on said pocket and then though at least one webbing loop on said diving jacket;

h. at least one webbing strap D-ring apparatus, said webbing strap D-ring apparatus having a D-ring attached to a plate, said plate having at least two parallel slots, said slots designed to be oriented perpendicular to said webbing straps and further designed to be insertably engaged by said webbing straps, said webbing strap D-ring apparatus designed to be independent from said diving jacket and be threadably attached to said jacket by said webbing straps.

26. The diving harness system of claim 25 wherein each of said members is designed to be generally linearly threaded through said first pair of pocket webbing loops, then threaded through said pair of diving jacket webbing loops, then threaded through said second pair of pocket webbing loops, through said ladder lock, and finally through a fastening device to form a belt-like device.

27. The diving harness system of claim 26 wherein said design of threading said members through said webbing loops comprises a generally planar and interlocking composition of webbing.

28. The diving harness system of claim 25, further comprising an accessory attached to said webbing straps, said accessory selected from the group consisting of D-rings, equipment pockets, weight integration pockets, diving light holders, load deployment systems, accessory bags, Jon lines, writing instruments, pony bottles, straps, and devices to further secure said diving harness system to the diver.

29. The diving harness system of claim 28 comprising a plurality of accessories attached to the webbing straps.

* * * * *